US008783528B1

(12) United States Patent
Hicks et al.

(10) Patent No.: US 8,783,528 B1
(45) Date of Patent: Jul. 22, 2014

(54) SLIDE GATE FOR CASTING OPERATIONS

(75) Inventors: James R. Hicks, Valparaiso, IN (US); Matthew C. Smith, Valparaiso, IN (US)

(73) Assignee: J.W. Hicks, Inc., Merrillville, IN (US)

( * ) Notice: Subject to any disclaimer, the term of this patent is extended or adjusted under 35 U.S.C. 154(b) by 226 days.

(21) Appl. No.: 13/219,803

(22) Filed: Aug. 29, 2011

Related U.S. Application Data

(60) Provisional application No. 61/377,651, filed on Aug. 27, 2010.

(51) Int. Cl.
*B22D 41/08* (2006.01)

(52) U.S. Cl.
USPC ..... 222/600; 266/236

(58) Field of Classification Search
USPC ..... 222/600; 266/236
See application file for complete search history.

(56) References Cited

U.S. PATENT DOCUMENTS

| | | | | |
|---|---|---|---|---|
| 3,760,993 | A | 9/1973 | Meier | |
| 4,415,103 | A * | 11/1983 | Shapland et al. | 222/590 |
| 4,660,749 | A | 4/1987 | Yokoi et al. | |
| 4,848,604 | A | 7/1989 | Fricker | |
| 5,141,139 | A | 8/1992 | Kleeblatt | |
| 5,421,563 | A | 6/1995 | Holtermann et al. | |
| 5,698,129 | A * | 12/1997 | Keller et al. | 222/600 |
| 5,836,485 | A | 11/1998 | Plattner et al. | |
| 6,045,015 | A * | 4/2000 | Waltenspuhl et al. | 222/600 |
| 6,422,435 | B1 | 7/2002 | Toaldo | |
| 7,455,201 | B2 | 11/2008 | Mitsui et al. | |

FOREIGN PATENT DOCUMENTS

| | | |
|---|---|---|
| CA | 1330248 | 6/1994 |
| CH | 639301 A5 | 11/1983 |
| DE | 3532260 A1 | 3/1986 |
| FR | 2090260 | 1/1972 |
| GB | 1357191 | 6/1974 |
| WO | 8801211 | 2/1988 |

OTHER PUBLICATIONS

Espacenet, Bibliographic data: CH639301 (A5), dated Feb. 18, 2014, 2 pages.

* cited by examiner

*Primary Examiner* — Scott Kastler
(74) *Attorney, Agent, or Firm* — Barnes & Thornburg LLP

(57) ABSTRACT

A slide gate includes first and second frame members, first and second nozzles, first and second plates, a biasing member, a hinge and an actuator. The first plate is connected to the first frame member. A passageway in the first nozzle is aligned with an opening in the first plate. The second plate is connected to the second frame member. A passageway in the second nozzle is aligned with an opening in the second plate. The biasing member includes a channel having a shaft extending through a spring located in the first frame member. The spring biases a retainer and the channel toward the first frame member. The second frame member includes a portion that rides in the channel. The actuator moves the second frame member along the channel to align the nozzle passageways to allow material to flow through the slide gate.

31 Claims, 10 Drawing Sheets

SLIDE GATE FOR CASTING OPERATIONS

The present invention relates to a slide gate and in particular to a slide gate for casting operations, such as casting steel or other liquid or molten materials.

BACKGROUND AND SUMMARY OF THE INVENTION

Slide gates for use in metal casting are known. Some of these slide gates include a fixed frame member with a fixed refractory plate connected thereto and a movable frame member with a movable refractory plate connected thereto. The fixed frame member can be attached to the lower surface of a vessel such as, for example, a ladle, tundish or furnace, adjacent an opening therein. A first fixed nozzle extends from the upper frame into the opening. A second nozzle extends downwardly from the movable frame member. Each of the nozzles and each of the refractory plates includes an opening extending therethrough. The opening in the upper nozzle and upper refractory plate are aligned. The movable frame member can be alternatively positioned such that the openings in the movable refractory plate and lower nozzle are aligned to varying degrees with the openings in the fixed refractory plate and upper nozzle, thereby allowing molten metal to flow from the vessel through the opening of the upper nozzle, the opening in the fixed refractory plate, the opening in the movable refractory plate and the opening in the lower nozzle. The greater the degree of alignment, the greater the rate of flow through the slide gate. Thus, the rate of flow can be increased or decreased by varying the degree of alignment during the casting operation. Alternatively, the movable frame member can be positioned such that the openings in the movable refractory plate and lower nozzle are not aligned with the openings in the fixed refractory plate and the upper nozzle, thereby preventing molten metal from flowing from the vessel and through the slide gate. Examples of known slide gates are shown in U.S. Pat. No. 6,422,435 to Toaldo and U.S. Pat. No. 7,455,201 to Mitsui, et al.

SUMMARY OF THE INVENTION

In one embodiment of the present invention, a slide gate generally includes first and second frame members, first and second nozzles, first and second plates, biasing members, a hinge and an actuator. The first plate is located in a recess in the first frame member. The first nozzle extends through an opening in the first frame member and has one end adjacent the first plate. A passageway in the first nozzle is aligned with an opening in the first plate. The second plate is located in a recess in the second frame member. The second nozzle extends through an opening in the second frame member and has one end adjacent the second plate. A passageway in the second nozzle is aligned with an opening in the second plate. The second frame member can pivot with respect to the first frame member about the hinge to alternately position the second plate adjacent the first plate or move the second plate away from the first plate. The biasing members can include a channel having a plurality of shafts extending therefrom and through springs located in a channel in the first frame member. The shafts are secured in place by a retainer that traps the springs in the channel such that the channel of the biasing members are biased upwardly toward the first frame member. The second frame member includes a plurality of rollers that ride in the channels, which bias the second frame member and plate toward the first frame member and plate when in use. The actuator moves the second frame member along the channels to selectively align the nozzle passageways and plate openings to allow material to flow through the slide gate.

In another embodiment of the present invention, a slide gate includes a first frame member having a first plate connected thereto, a channel and a spring located at least in part in the channel. A second frame member has a second plate connected thereto. The second frame member is moveable between a first position in which the second plate is positioned adjacent the first plate and a second position in which the second plate is positioned away from the first plate. A first nozzle extends through an opening in the first frame member, the first nozzle having a first end, a second end and a passageway extending between the first and second ends and aligned with an opening in the first plate. A second nozzle extends through an opening in the second frame member and has a first end, a second end and a passageway extending between the first and second ends and aligned with an opening in the second plate. A biasing member includes a channel having a first surface, a second surface and at least one shaft extending from the second surface and through the spring located in the channel of the first frame member. A retainer retains the spring in the channel of the first frame member. A portion of the second frame member is configured to be located within the channel of the biasing member and movable therein. The shaft may be located above this portion of the second frame member when it is located in the channel of the biasing member.

In one embodiment, the shaft is integrally formed with the channel of the biasing member. In another embodiment, the channel of the biasing member includes an opening and the shaft includes a first end configured to extend through the opening and a second end configured to be retained by a surface surrounding the opening.

In one embodiment, the biasing member biases the second frame member and plate toward the first frame member and plate as the portion of the second frame member moves within the channel of the biasing member. In another embodiment, the channel of the biasing member is biased toward the first frame member.

In one embodiment, the second frame member is movable by an actuator in a direction parallel to the first frame member to selectively align the first nozzle passageway and the opening in the first plate with the second nozzle passageway and the opening in the second plate.

In one embodiment, the shaft includes a recessed segment and a portion of the retainer is located in the recessed segment. In another embodiment, the retainer engages the shaft and the spring biases the retainer in a first direction, thereby biasing the channel of the biasing member in the first direction.

In another embodiment, the slide gate includes a hinge having at least two arms extending from the first frame member, a pin extending from each arm and at least two openings connected to the second frame member for selectively receiving the pins. The pins may extend toward an actuator for moving the second frame member relative to the first frame member.

In other embodiments of the present invention, the channel of the biasing member is generally C-shaped or generally L-shaped.

A slide gate according to another embodiment of the present invention includes a first frame member having a channel, a biasing member including a channel and at least one shaft extending from the channel, a retainer and a spring located at least in part in the channel of the first frame member so as to bias the retainer in a first direction, thereby biasing the channel of the biasing member in the first direction. The shaft can include a recessed segment and a portion of the retainer can be located in the recessed segment. In another embodiment, the shaft extends through the spring.

In another embodiment of the present invention, a slide gate includes a first frame member, a first plate located at least in part in the first frame member and a second frame member having a second plate located at least in part in the second frame member. The second frame member is moveable between a first position in which the second plate is positioned adjacent the first plate and a second position in which the second plate is positioned away from the first plate. The slide gate further includes means for biasing the second frame member toward the first frame member when the second frame member is in the second position. The means for biasing may include a channel and a shaft extending from the channel. The means for biasing can further include a spring and the shaft can extend through the spring. In another embodiment, the means for biasing includes a retainer biased in a first direction by the spring. The retainer can engage the shaft. The shaft can include a recessed segment and a portion of the retainer may be located in the recessed segment. In yet another embodiment, the spring is located in a channel in the first frame member.

In another embodiment of the present invention, a slide gate includes a first frame member having a first surface and a second surface, a first plate associated with the first frame member, a second frame member having a first surface facing the second surface of the first frame member and a second surface opposite the first surface of the second frame member, a second plate associated with the second frame member, a spring located closer to the first surface of the first frame member than the second surface of the first frame member and a biasing member having a first portion disposed opposite the second surface of the second frame member and a second portion extending through the spring.

DETAILED DESCRIPTION OF THE PREFERRED EMBODIMENTS

Figure 1:
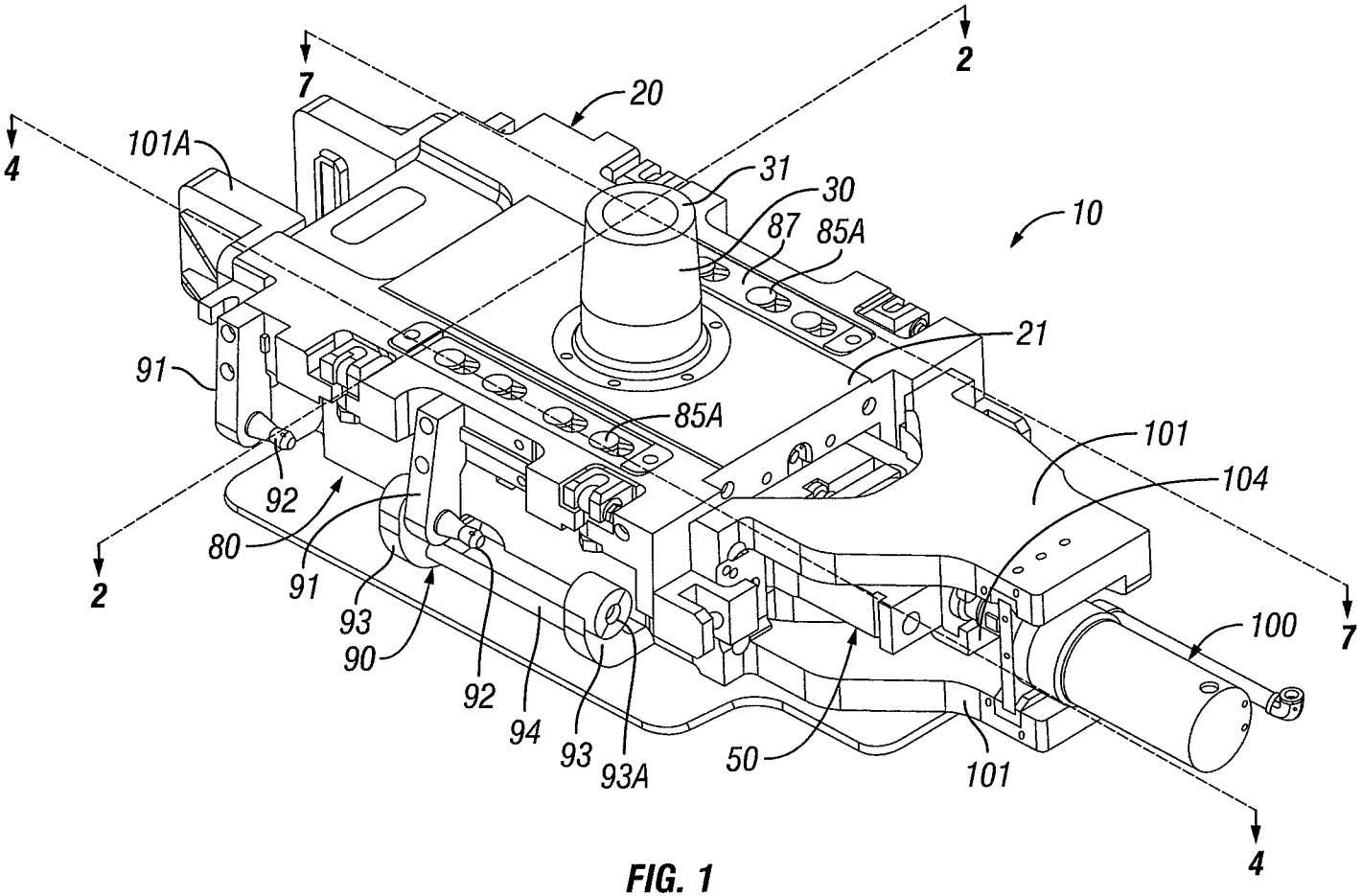
FIG. 1 is a perspective view of a slide gate according to one embodiment of the present invention.

FIG. 1 is a perspective view of a slide gate 10 according to one embodiment of the present invention. Slide gate 10 generally includes a first frame member 20, a first nozzle 30, a first plate 40, a second frame member 50, a second nozzle 60, a second plate 70, biasing members 80, a hinge 90 and an actuator or drive mechanism 100.

Figure 2:
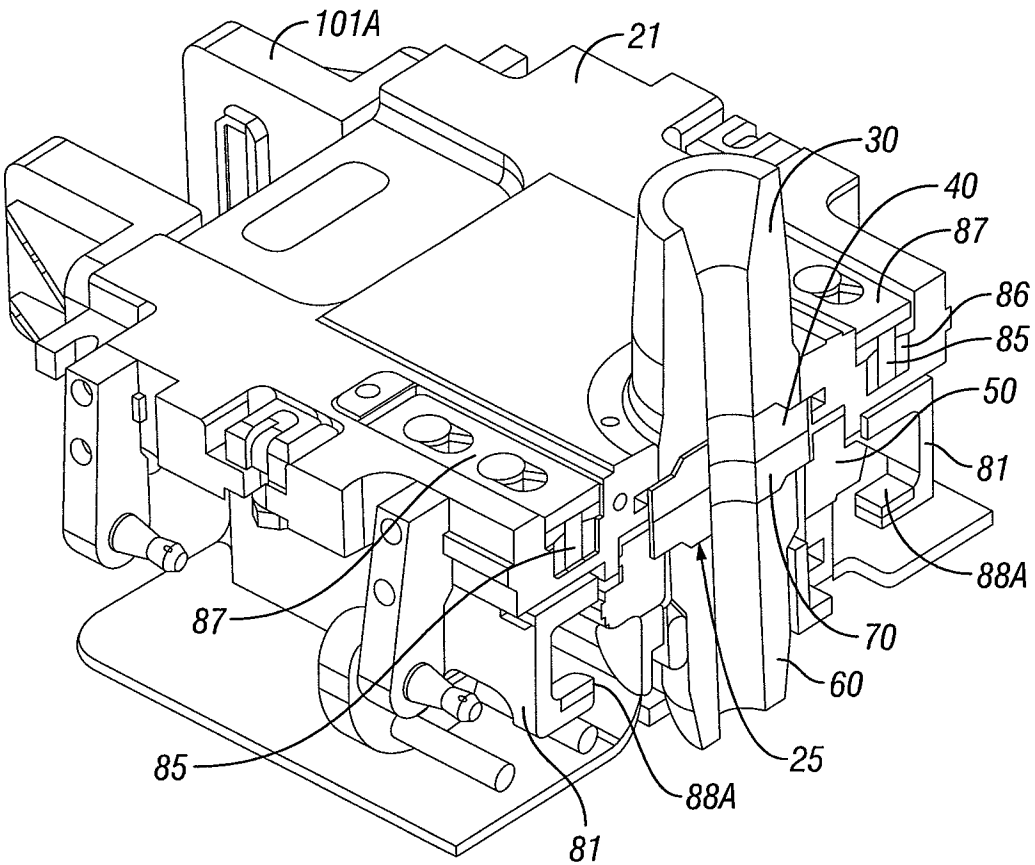
FIG. 2 is a perspective, cross-sectional view taken along line 2-2 in FIG. 1.
Figure 3:
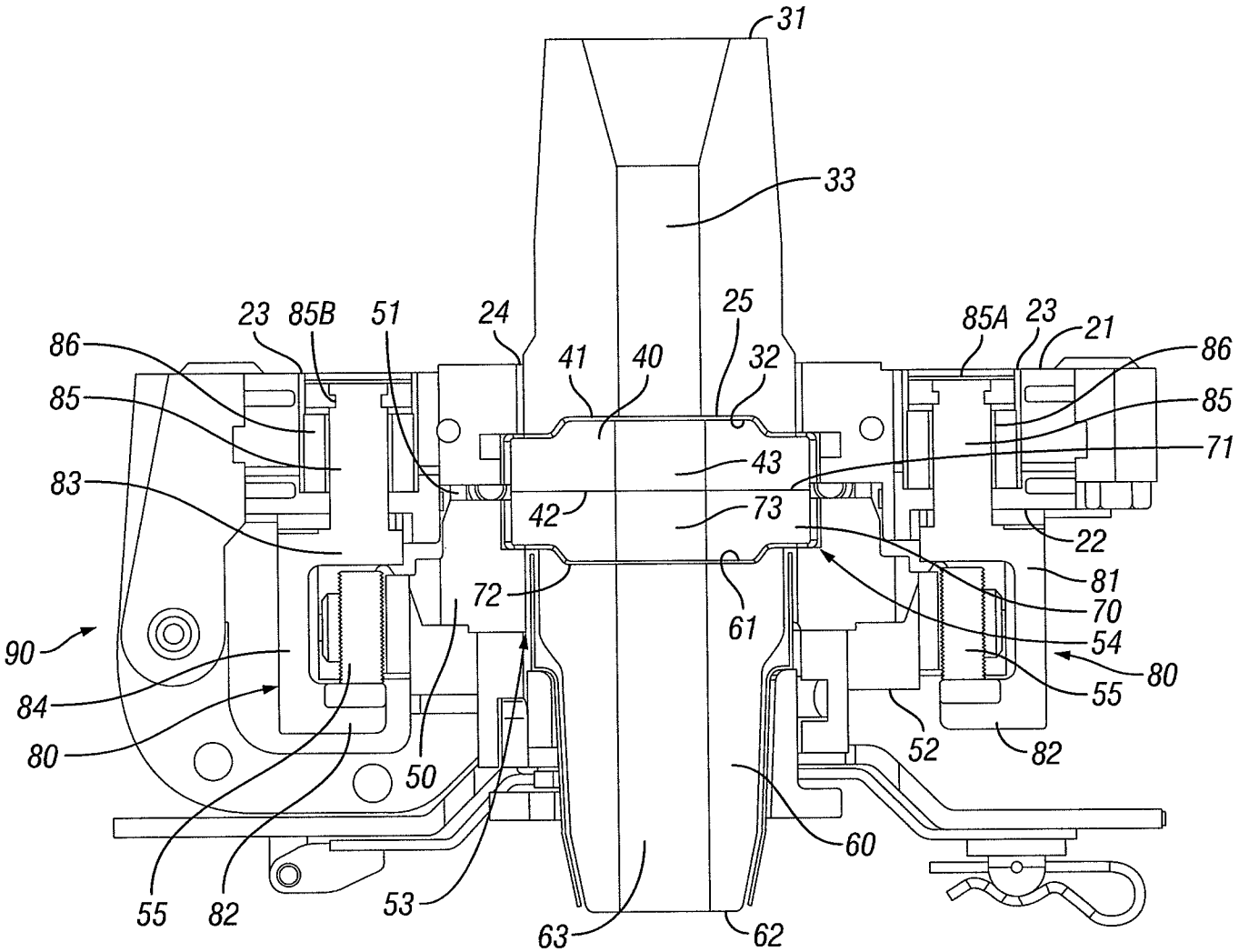
FIG. 3 is an elevational view taken along line 2-2 in FIG. 1.
Figure 4:
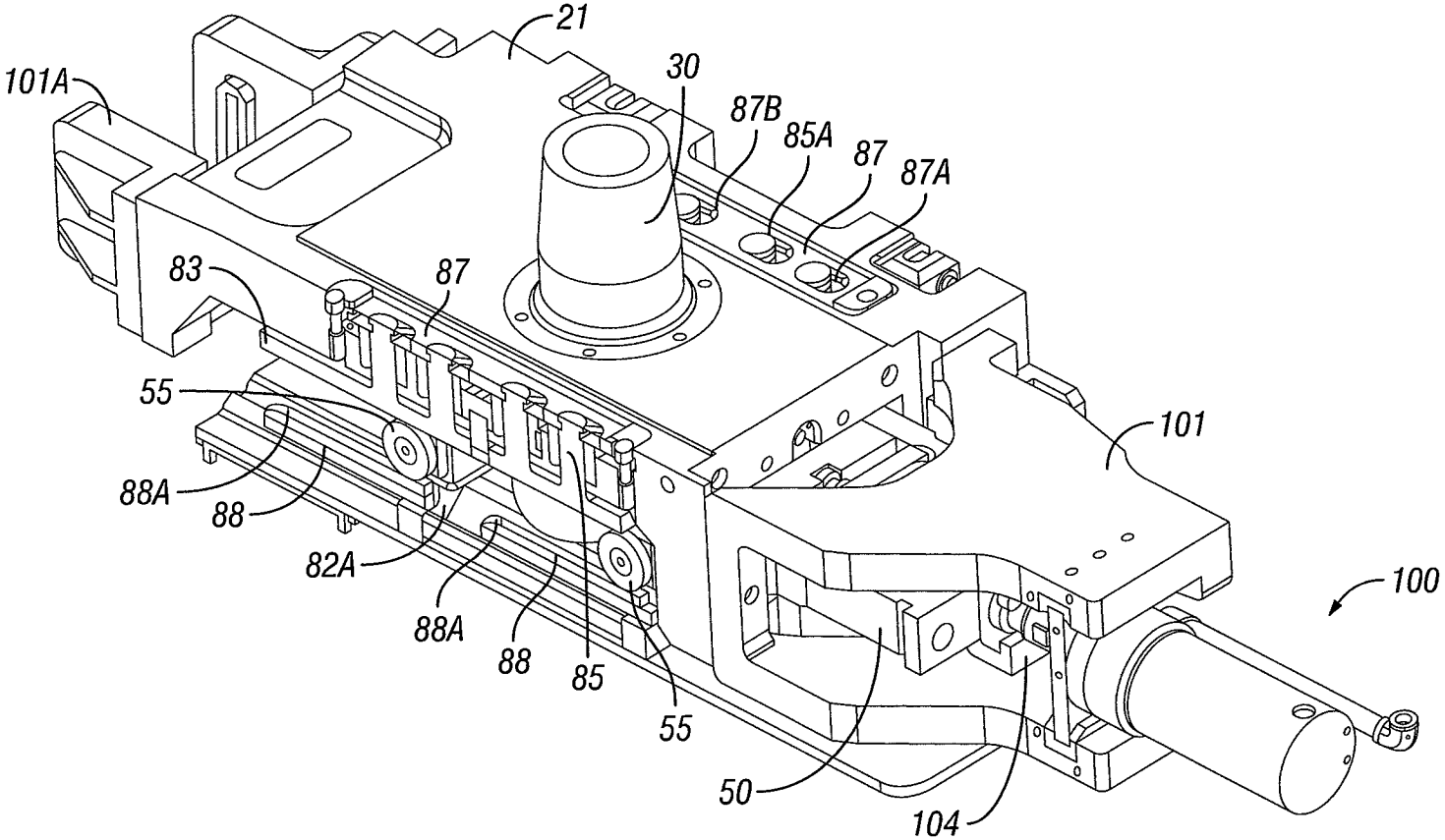
FIG. 4 is an elevational cross-sectional view taken along line 4-4 in FIG. 1.
Figure 5:
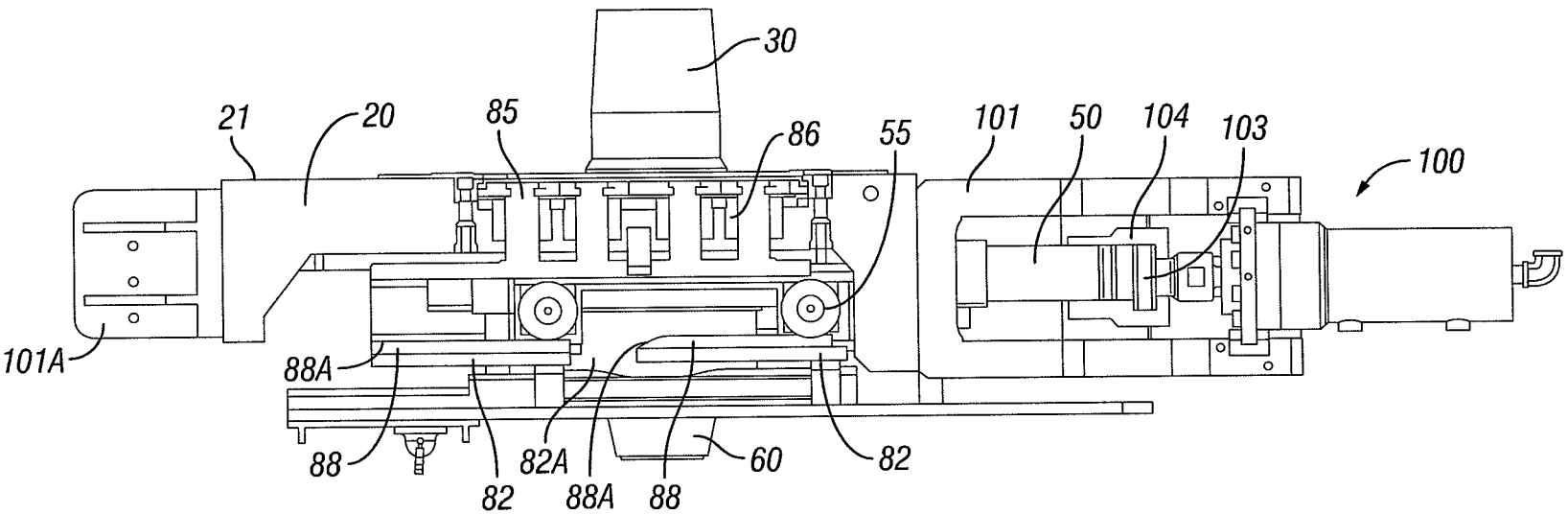
FIG. 5 is an elevational view taken along line 4-4 in FIG. 1.

Referring to FIGS. 2 and 3, first frame member 20 generally includes a first or upper surface 21, a second or lower surface 22, two channels 23, an opening 24 and a cavity or recessed area 25.

First nozzle 30 is a generally cylindrical member including a first end 31, a second end 32 and an opening or passageway 33 extending from first end 31 to second end 32.

In the embodiment shown first plate 40 is a generally oval-shaped member having a first surface 41, a second surface 42 and an opening or passageway 43 extending therethrough from first surface 41 to second surface 42.

As shown in. FIGS. 2 and 3, first nozzle 30 extends through opening 24 in first frame member 20 such that second end 32 is adjacent first surface 41 of first plate 40. First plate 40 is located and retained in recessed area 25 of first frame member 20 in a manner known in the art. First nozzle 30 and first plate 40 are typically made from a refractory material, such as an alumina carbon material.

Second frame 50 generally includes a first or upper surface 51, a second or lower surface 52, an opening 53, a cavity or recessed area 54 and a plurality of a wheels or rollers 55.

Second nozzle 60 is a generally cylindrical member including a first end 61, a second end 62 and an opening or passageway 63 extending from first end 61 to second end 62.

In the embodiment shown second plate 70 is a generally oval-shaped member having a first surface 71, a second surface 72 and an opening or passageway 73 extending therethrough from first surface 71 to second surface 72.

Second nozzle 60 extends through opening 53 in second frame member 50 such that first end 61 is adjacent second surface 72 of second plate 70. Second plate 70 is located and retained in recessed area 54 of first second frame member 50 in a manner known in the art. Second nozzle 60 and second plate 70 are typically made from a refractory material, such as an alumina carbon material.

Figure 6:
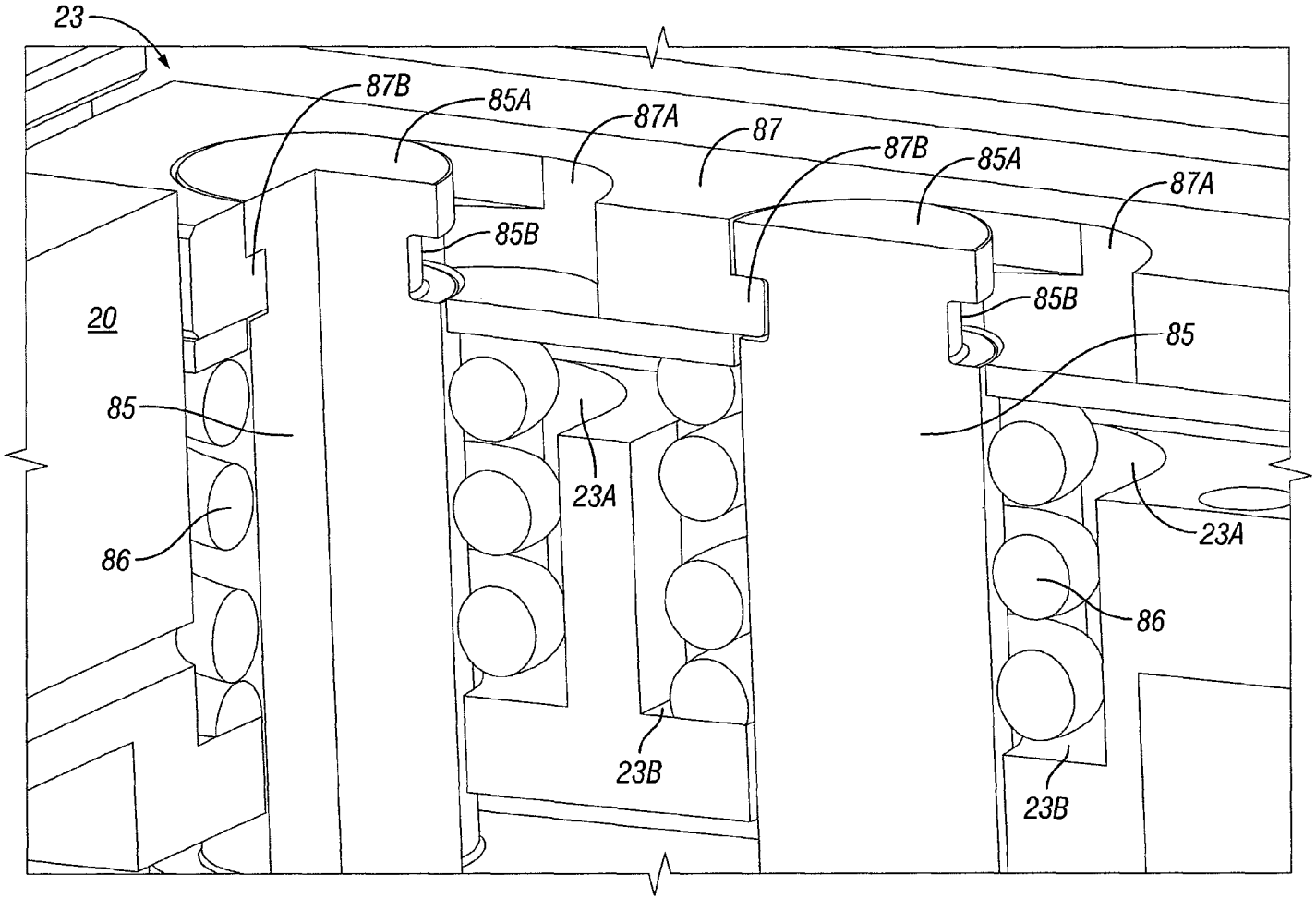
FIG. 6 is a sectional view of a portion of a biasing member that is a component of the slide gate of FIG. 1.
Figure 7:
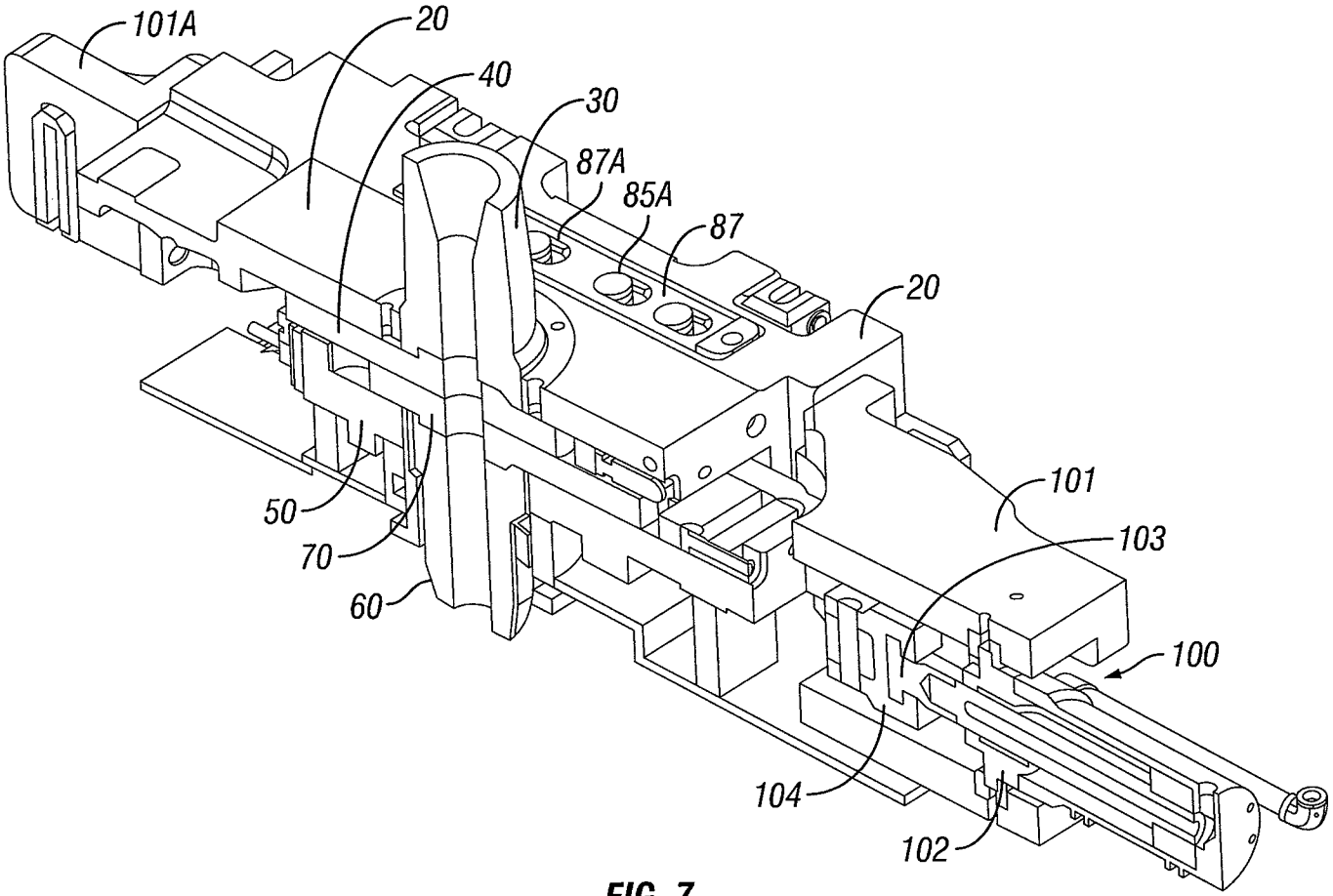
FIG. 7 is a perspective sectional view taken along line 7-7 in FIG. 1.

As shown in FIGS. 2-6, biasing members 80 each include a channel 81. In the embodiment shown, channels 81 are generally C-shaped and each includes a lower horizontal member 82 and an upper horizontal member 83 connected by a substantially vertical member 84. Lower horizontal members 82 include openings 82A. A plurality of shafts 85 extend vertically from upper horizontal portions 83 through biasing means 86 and terminate in end 85A. In the embodiment shown, each biasing means 86 is a coil spring. Shafts 85 include circumferential grooves 85B adjacent ends 85A. Ends 85A extend into a retainer 87 via openings 87A therein. Each retainer 87 includes lips 87B that engage grooves 85B to secure ends 85A of shafts 85 in place. As shown in FIG. 6, biasing means 86 are located in generally cylindrical cavities 23A in channels 23 of first frame member 20 between retainers 87 and the lower ends 23B of cavities 23A. A track or guide surface 88 is formed integrally with or secured to horizontal members 82. One end 88A of each track or guide surface 88 includes a slanted or ramp portion 88A.

As shown in FIG. 1, hinge 90 generally includes a pair of vertically extending arms 91 that extend from first frame 20. Each member 91 includes a generally horizontally extending pin 92 at one end thereof. Hinge 90 further includes a pair of generally J-shaped members 93 joined by shaft 94. Each member 93 includes an opening 93A for engaging one of the pins 92 as described in greater detail below.

Referring to FIGS. 4, 5, 7 and 8, actuator 100 is connected to first frame member 20 by a bracket 101. Actuator 100 includes a movable cylinder 102 that terminates in a generally T-shaped end 103. End 103 engages a bracket 104 which is secured to one end of second frame member 50. Actuator 100 moves second frame member 50, second nozzle 60 and second plate 70 as described below. In the embodiment shown, a second actuator bracket 101A is connected to the opposite end of first frame member 20. In this embodiment, actuator 100 is utilized to control the flow of material through slide gate 10 during casting (as described below) and a second actuator (not shown) is used to disengage second frame member 50 from first frame member 20 to service slide gate 10. Alternatively, a single actuator can be operated from one end of slide gate 10 for both casting and service operations.

Figure 8:
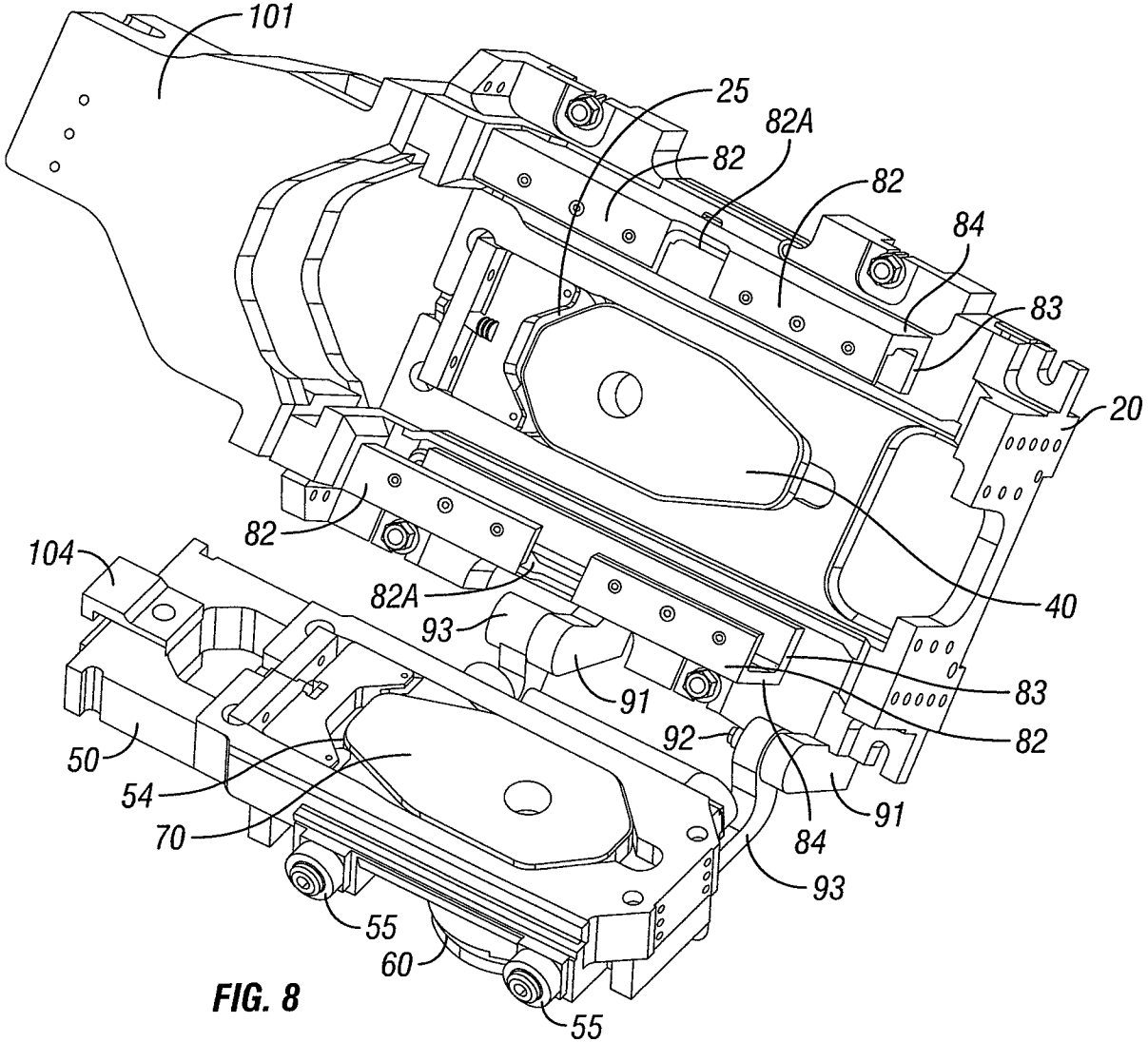
FIG. 8 is perspective view of the slide gate of FIG. 1 in the open position.

FIG. 8 shows slide gate 10 in the open position. In this position, pins 92 of hinge 90 are located in openings 93A such that second frame member 50 along with second nozzle 60 and second plate 70 can be pivoted away from first frame member 20, first nozzle 30 and first plate 40 as shown. Note that movement of second frame member 50 (as described below) alternately engages and disengages pins 92 from openings 93A of hinge 90, depending on the location of second frame member 50.

To utilize slide gate 10, second frame member 50 is pivoted about hinge 90 to place second plate 70 adjacent first plate 40. Note that in the position shown in FIG. 8, when second frame member 50 is pivoted toward first frame member 20, two rollers 55 will be positioned within openings 82A of lower horizontal members 82 and the remaining two rollers 55 will be adjacent an end of channel 81. End 103 of cylinder 102 is then engaged with bracket 104 and cylinder 102 is retracted, thereby causing rollers 55 to ride along surfaces 87A and onto surfaces 87 of horizontal members 82. As cylinder 102 draws rollers 55 upward along surfaces 87A and onto surfaces 87, second frame member 50 and second plate 70 are drawn upward toward first frame member 20 and first plate 40 by biasing members 80. Specifically, biasing means 86 in channels 23 bias retainers 87 upwardly, which in turn draw shafts 85, channel 81 and second frame member 50 upward.

In use, slide gate 10 is positioned beneath a container or vessel, such as, for example a ladle, tundish or furnace, such that passageway 33 in first nozzle 30 is aligned with an opening in the bottom of the vessel, as is known in the art. In this position, cylinder 102 can be actuated to move second frame 50 and, therefore, second nozzle 60 and second plate 70 such that openings 63 and 73 are alternatively aligned or unaligned with openings 33 and 43 in first nozzle 30 and first plate 40. When all the openings are at least partially aligned, metal or other material can flow through openings 33, 43, 73 and 63. Varying the degree of alignment controls the flow of material through slide gate 10. Actuating cylinder 103 to move the various openings completely out of alignment will result in first surface 71 of second plate 70 obstructing opening 43 in first plate 40, thereby blocking the flow of material.

Figure 9:
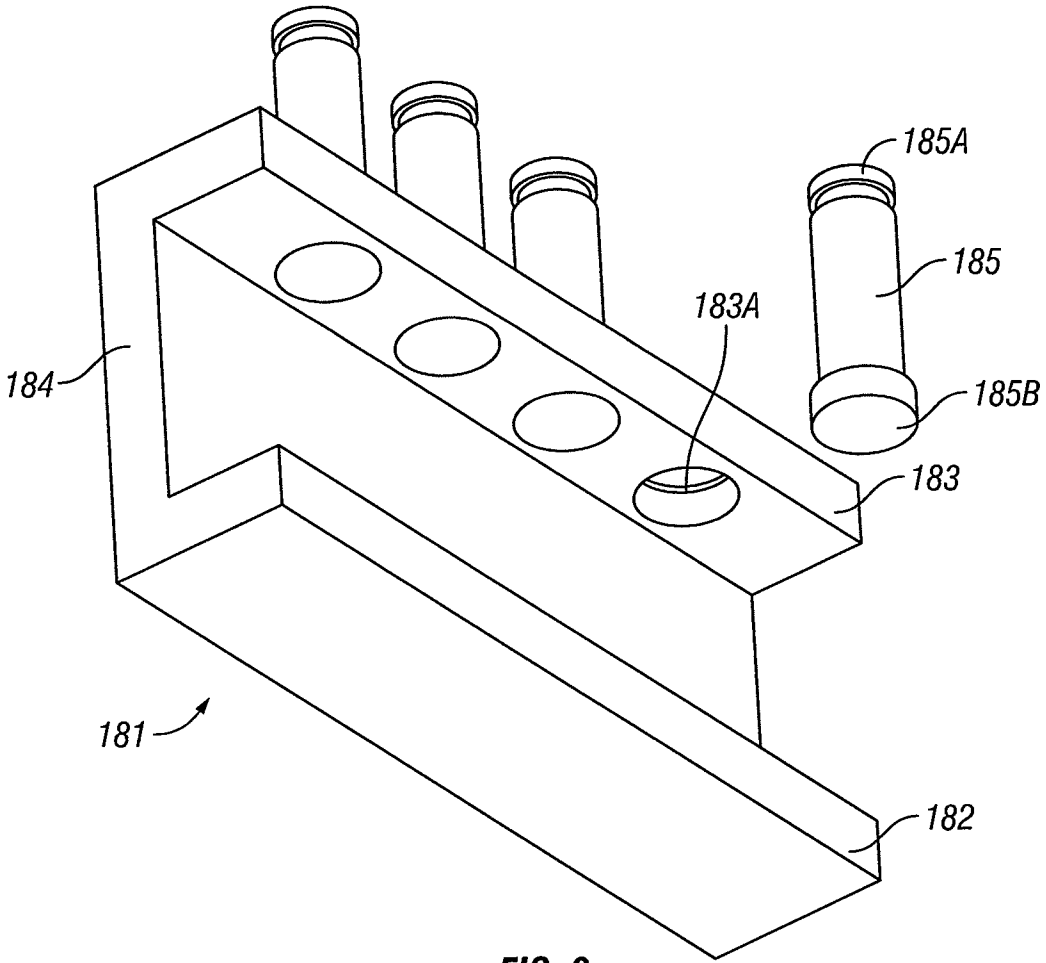
FIG. 9 is a perspective view of an alternative embodiment of a portion of a biasing member that is a component of a slide gate according to one embodiment of the present invention.

FIG. 9 shows an alternative embodiment of a portion of a biasing member 180. In this embodiment, shafts 185 are not integrally formed with channel 181. Rather, upper horizontal member 183 includes counter bores 183A and shafts 185 include an enlarged end 185B. Ends 185A are inserted through counter bores 183A such that ends 185B contact the inner surface of the counter bores 183A. Shafts 185 may then be secured to upper horizontal member 183 by welding or other means.

Figure 10:
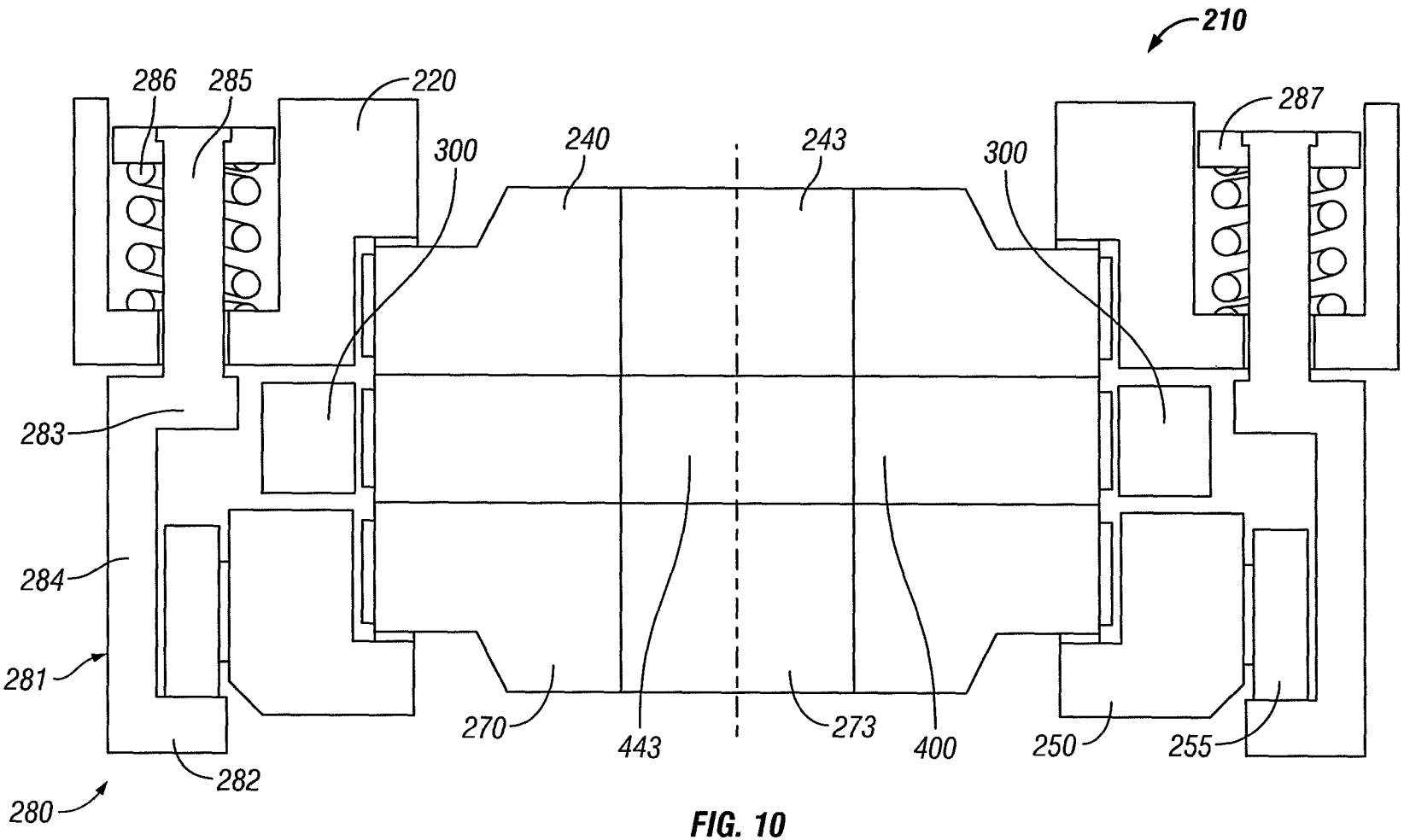
FIG. 10 is a cross-sectional view of a slide gate according to another embodiment of the present invention.

FIG. 10 is a cross-sectional view of another embodiment of a slide gate according to the present invention. In this embodiment, elements generally corresponding to those shown in the embodiment of FIG. 1 have been assigned a three digit number beginning with "2" and the remaining two digits identify the corresponding feature from the prior embodiment. As shown in FIG. 10, a first frame member 220 is associated with a first plate 240 and a second frame member 250 is associated with a second plate 270. Biasing members 280 include channels 281. Wheels or rollers 255 connected to second frame member 250 can be positioned in channels 281 in the same manner as described above and ride along the upper surface of first horizontal member 282. In this embodiment, a third frame member 300 having a third plate 400 associated therewith is positioned between first frame member 220 and second frame member 250. An actuator (not shown) is connected to third frame member 300. In use, the components are arranged as shown and second frame member 250 is positioned such that rollers 255 align with openings (not shown) in lower horizontal members 282 in a manner similar to that described above and second frame member 250 is actuated so as to move rollers 255 along second horizontal member 282, thereby clamping third frame member 300 and third plate 400 between first frame member 220, first plate 240, second frame member 250 and second plate 270. In this embodiment, first frame member 220, first plate 240, second frame member 250 and second plate 270 remain stationary during casting. The flow of material through slide gate 210 is controlled by moving third frame member 300 and its associated third plate 400 to control the alignment through passageways 243, 273 and 443.

Although the present invention has been shown and described in detail the same is to be taken by way of example only and not by way of limitation. Numerous changes can be made to the embodiments shown without departing from the scope of the invention. For example, hinge 90 does not have to include two pins and corresponding holes. Rather, hinge 90 can have any configuration that permits one of first frame member 20 and second frame member 50 to pivot with respect to each other. Alternatively, hinge 90 can be eliminated and second frame member 50 can be positioned for use in channel 81 by a crane or other device. It is also not necessary to locate first plate 40 and second plate 70 in recesses in first frame member 20 and second frame member 50. Rather, the plates can be secured to the frame members through any of a number of mechanisms known in the art, such as through the use of magnets and magnetic materials, pins, abutment structures or other features. In other embodiments, rollers 55 are eliminated and a portion of second frame member 50 slides on the upper surface of lower horizontal member 82 of channel 81. In such an embodiment, the portion of second frame member 50 that slides on lower horizontal member 82 can be configured to extend from second frame member 50 and pass through openings 82*k* Channels 81 could also be generally L-shaped instead of C-shaped. In such an embodiment, upper horizontal member 83 would be eliminated and the shaft would extend from vertical member 84. Regardless of whether channel 81 is generally C-shaped or L-shaped, shaft 85 could extend from the outer surface of vertical member 84. In other embodiments, springs 86 may be positioned on an upwardly facing surface of first frame member 20, as opposed to being recessed in a channel formed in a surface of first frame member 20. The present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

What is claimed is:

1. A slide gate, including:

a first frame member having a channel and a spring located at least in part in the channel;

a first plate connected to the first frame member;

a second frame member having a second plate connected thereto, the second frame member being moveable between a first position in which the second plate is positioned adjacent the first plate and a second position in which the second plate is positioned away from the first plate;

a first nozzle extending through an opening in the first frame member, the first nozzle having a first end, a second end and a passageway extending between the first and second ends and aligned with an opening in the first plate;

a second nozzle extending through an opening in the second frame member, the second nozzle having a first end, a second end and a passageway extending between the first and second ends and aligned with an opening in the second plate;

a biasing member including a channel having a first surface, a second surface and at least one shaft extending from the second surface and through the spring located in the channel of the first frame member;

a retainer for retaining the spring in the channel of the first frame member; and a portion of the second frame member configured to be located within the channel of the biasing member and movable therein.

2. A slide gate according to claim 1, wherein the second frame member is movable in a direction parallel to the first frame member.

3. A slide gate according to claim 2, further including an actuator for moving the second frame member along the channel of the biasing member to selectively align the first nozzle passageway and the opening in the first plate with the second nozzle passageway and the opening in the second plate.

4. A slide gate according to claim 1, wherein the biasing member biases the second frame member and plate toward the first frame member and plate as the portion of the second frame member moves within the channel of the biasing member.

5. A slide gate according to claim 1, wherein the shaft includes a recessed segment and a portion of the retainer is located in the recessed segment.

6. A slide gate according to claim 1, wherein the retainer engages the shaft and the spring biases the retainer in a first direction, thereby biasing the channel of the biasing member in the first direction.

7. A slide gate according to claim 1, wherein the second surface of the biasing member channel is located above the first surface of the biasing member channel.

8. A slide gate according to claim 1, wherein the shaft is located above the portion of the second frame member moveable in the channel of the biasing member.

9. A slide gate according to claim 1, wherein the channel of the biasing member is biased toward the first frame member.

10. A slide gate according to claim 1, further including a hinge having at least two arms extending from the first frame member, a pin extending from each arm and at least two openings connected to the second frame member for selectively receiving the pins.

11. A slide gate according to claim 10, further including an actuator for moving the second frame member relative to the first frame member and wherein the pins extend toward the actuator.

12. A slide gate according to claim 1, wherein the first frame member includes a recess and at least a portion of the first plate is located in the recess.

13. A slide gate according to claim 12, wherein the second frame member includes a recess and at least a portion of the second plate is located in the recess.

14. A slide gate according to claim 1, wherein the second frame member is pivotable with respect to the first frame member.

15. A slide gate according to claim 1, wherein the portion of the second frame member configured to be located within the channel of the biasing member and movable therein includes at least one roller connected to the second frame member.

16. A slide gate according to claim 1, wherein the channel of the biasing member is generally C-shaped.

17. A slide gate according to claim 1, wherein the channel of the biasing member is generally L-shaped.

18. A slide gate according to claim 1, wherein the shaft is integrally formed with the channel of the biasing member.

19. A slide gate according to claim 1, wherein the channel of the biasing member includes an opening and the shaft includes a first end configured to extend through the opening and a second end configured to be retained by a surface surrounding the opening.

20. A slide gate according to claim 1, further including a third frame member located between the first and second frame members and a third plate connected to the third frame member.

21. A slide gate according to claim 20, wherein the third frame member is moveable relative to the first and second frame members to control the flow of material through the slide gate.

22. A slide gate, including:

a first frame member having a channel and a spring located at least in part in the channel;

a second frame member moveable between a first position and a second position;

a biasing member including a channel; and a portion of the second frame member configured to be located within the channel of the biasing member and movable therein.

23. A slide gate according to claim 22, wherein the second frame member is movable in a direction parallel to the first frame member.

24. A slide gate according to claim 22, wherein the biasing member biases the second frame member toward the first frame member as the portion of the second frame member moves within the channel of the biasing member.

25. A slide gate according to claim 22, wherein the second surface of the biasing member channel is located above the first surface of the biasing member channel.

26. A slide gate according to claim 22, wherein the channel of the biasing member is biased toward the first frame member.

27. A slide gate according to claim 22, further including a hinge having at least two arms extending from the first frame member, a pin extending from each arm and at least two openings connected to the second frame member for selectively receiving the pins.

28. A slide gate according to claim 22, wherein the second frame member is pivotable with respect to the first frame member.

29. A slide gate according to claim 22, wherein the portion of the second frame member configured to be located within the channel of the biasing member and movable therein includes at least one roller connected to the second frame member.

30. A slide gate according to claim 22, wherein the channel of the biasing member is generally C-shaped.

31. A slide gate according to claim 22, wherein the channel of the biasing member is generally L-shaped.

* * * * *